US006138605A

United States Patent [19]

O'Brien

[11] Patent Number: 6,138,605

[45] Date of Patent: Oct. 31, 2000

[54] ACCESS AND EVACUATION APPARATUS WITH ARTICULATED ARM

[75] Inventor: Daniel P. O'Brien, St. John's, Canada

[73] Assignee: Seascape Systems Limited, Newfoundland, Canada

[21] Appl. No.: 09/129,096

[22] Filed: Aug. 5, 1998

[51] Int. Cl.[7] ..... B32B 23/04

[52] U.S. Cl. ..... 114/365; 114/366; 114/373; 182/213

[58] Field of Search ..... 114/365, 366, 114/368, 369, 373, 377, 259; 414/137.7; 182/2.3, 2.8

[56] References Cited

U.S. PATENT DOCUMENTS

| | | | |
|---|---|---|---|
| 426,449 | 4/1890 | Hosford . | |
| 582,069 | 5/1897 | Leslie . | |
| 609,532 | 8/1898 | Cappellini . | |
| 800,841 | 10/1905 | Burt . | |
| 1,265,771 | 5/1918 | Grohmann . | |
| 1,827,534 | 10/1931 | McKenzie . | |
| 2,091,327 | 8/1937 | McPartland . | |
| 2,349,268 | 5/1944 | Hartzog | 114/365 |
| 2,398,274 | 4/1946 | Albert . | |
| 2,694,996 | 11/1954 | Poche . | |
| 3,596,623 | 8/1971 | Frankel . | |
| 3,741,143 | 6/1973 | McKinley et al. | 182/2.3 |
| 3,778,855 | 12/1973 | Kariagin . | |
| 3,880,254 | 4/1975 | Fitzgerald et al. | 182/2 |
| 4,202,427 | 5/1980 | Sada . | |
| 4,522,144 | 6/1985 | Klem . | |
| 4,633,802 | 1/1987 | Olsen . | |
| 4,781,144 | 11/1988 | O'Brien . | |
| 5,253,606 | 10/1993 | Ortelli . | |
| 5,341,761 | 8/1994 | O'Brien . | |
| 5,706,755 | 1/1998 | O'Brien . | |

FOREIGN PATENT DOCUMENTS

| | | |
|---|---|---|
| 1208082 | 7/1986 | Canada . |
| 3314774 A1 | 10/1984 | Germany . |
| 3329 159 A1 | 2/1985 | Germany . |
| 120140 | 10/1918 | United Kingdom . |
| 2108054 | 5/1983 | United Kingdom . |
| 2123353 | 2/1984 | United Kingdom . |
| 2135272 | 8/1984 | United Kingdom . |

OTHER PUBLICATIONS

Newspaper article entitled "Oil rig evacuation device is designed to save lives," from *The Evening Telegram*, p. 16, dated Feb. 17, 1991.

Offshore Technology Conference paper, *An Offshore Evacuation System: A Safe Haven and an Emergency Control Centre*, May, 1985, Houston, Texas, B. Bengtsson, S. Thulin.

*Rig disaster—why not hang around for a while?*, 4525 *Ship & Boat International* (1985) Oct., No. 8, UK, pp. 65–66.

Newpaper article entitled "Seascape Systems plans to build rig evaculation system prototype," *The Sunday Express* dated Feb. 23, 1990.

Sketch of a proposed evacuation system by Gerald B. Malone of St. John's Newfoundland, allegedly sent to the Canadian Petroleum Association, Offshore Operations Division in 1985.

*Primary Examiner*—Sherman Basinger

*Attorney, Agent, or Firm*—Nath & Associates; Gary M. Nath; Harold L. Novick

[57] ABSTRACT

There is provided an improved access and evacuation apparatus for an offshore platform, in which the apparatus comprises an articulated arm for rotatably mounting on an offshore platform. The arm comprises an inner part which has first and second ends and an outer part also having first and second ends. The first end of the inner part is adapted for rotatably mounting on the platform and the second end of the inner part is rotatably connected to the first end of the outer part. The arm is selectively moveable between an upper position in which the second end of the outer part is adjacent the platform, and a lower position in which the second end of the outer part is below the surface of the water and remote from the platform. There is also provided a winch and a cable operatively connecting the winch to the arm.

25 Claims, 6 Drawing Sheets

ACCESS AND EVACUATION APPARATUS WITH ARTICULATED ARM

FIELD OF THE INVENTION

This application relates to access and evacuation systems for offshore work platforms, such as drilling and production platforms in the offshore petroleum industry.

BACKGROUND OF THE INVENTION

Offshore platforms for various uses, including ocean research, are in widespread use throughout the world. The majority of these platforms are found in the offshore petroleum industry in exploration and production functions.

The offshore drilling industry and technology associated with it have developed rapidly in the last 30 years. The drilling rigs in use today have evolved into sophisticated structures, designed and built to withstand the severest of environmental conditions and to operate in very deep waters. Advanced computer technology has contributed substantially to bring platform development to its present position. Computers are integral, for example, to the collection and evaluation of geological and seismic data, to the operation of dynamically positioned platforms, and to methods of well control.

Furthermore, such modern technology has led to the development of platforms serving various functions and which are in the normal course of operation unmanned. Characteristically, these unmanned platforms are required to be maintained on a regular basis and to therefore be accessible to maintenance crews. Currently and for some years access to these platforms has been by helicopter. There are, however, very significant disadvantages in the use of helicopters to access platforms. The platform structure itself is required to be provided with a helicopter landing pad. This is a very significant expense and, as well, an engineering disadvantage on many small platforms. Finally, helicopter usage is the single most dangerous aspect of the offshore industry.

These normally unmanned platforms are required to carry lifeboats and launch systems for use in case a life threatening situation develops while a maintenance crew is on the platform.

As is well documented, evacuation systems used in emergency evacuation of offshore platforms have not performed well with resulting high loss of life. There has therefore been an ongoing search for more reliable evacuation systems.

At the same time, the increasing use of unmanned platforms, and the problems discussed above incident to those platforms, have led to a need for better access systems for such platforms.

The applicant herein has developed several access and evacuation systems to address a number of the problems discussed above, including the development of a unique marine access craft for use in the systems. Reference may be had, for example, to applicant's U.S. Pat. No. 5,341,761, "Evacuation System", U.S. Pat. No. 4,781,144, "Off-Shore Drilling Installation Evacuation System" and U.S. Pat. No. 5,706,755, "Access and Evacuation System for Offshore Platform".

In some instances, however, certain geographic locations dictate specific design needs to the access and evacuation system. For example, the prevailing tides or water conditions may require a different launching mechanism for the evacuation craft, or an ice buildup around the offshore platform may require that the craft be placed in the water in a different manner than current systems. One such example is the "100 year ice rubble condition" found north of Sakhalin Island in the Sea of Okhotsk in eastern Russia, in which the ice rubble can be expected to extend out approximately 25 meters beyond the edge of the platform. There are no existing systems which are specifically designed to address this severe ice rubble problem.

Against this background, the present invention combines aspects of applicant's previous systems with a unique articulated deployment arm to address a number of the problems discussed above. A unique support bracket and deployment mechanism for the marine access craft is provided for use in the system.

A number of systems have described the use of an articulated or segmented arm for evacuation of personnel from ships or floating platforms and for the loading and unloading of cargo or smaller vessels to and from ships.

U.S. Pat. No. 3,596,623 of Frankel, issued Aug. 3, 1971, describes an apparatus for coupling a smaller ship to a larger ship. The apparatus taught in that reference relies upon buoyancy means to "float" the second portion of the coupling platform to a location in the water to receive the small ship.

U.S. Pat. No. 4,202,427 of Sada, issued May 13, 1980, describes a complicated structure in which an A-frame is releasably secured to a platform. The A-frame is released and is moved to a secondary position controlled by guy wires, at the same time as the hangar spar rotates away from the A-frame into a vertical position, after which the wires control the lowering of the personnel capsule vertically onto an escape vessel, such as a ship, or onto another level of the platform.

U.S. Pat. No. 4,633,802 of Olsen, issued Jan. 6, 1987, provides an apparatus for launching a float or the like from a ship in which an upper portion of the arm is fixed in position relative to the ship. The lower portion is releasably secured to the upper portion and upon release, is biased into a launch position by a spring connecting the upper and lower portions, in a catapult like fashion. The float is then launched into the water. The device is not suitable for evacuating personnel but is designed for placing floats, buoys and the like in the water.

U.S. Pat. No. 5,253,606 of Ortelli, issued Oct. 19, 1993, provides a machine for gripping, securing and handling underwater vehicles and the like in which the portions of an articulated arm are controlled by a piston on each portion. The lower portion is permitted to move in several directions to assist alignment with the object to be gripped.

SUMMARY OF THE INVENTION

There is provided an improved access and evacuation apparatus for offshore work platforms, such as drilling and production platforms in the offshore petroleum industry.

In one aspect of the invention, there is provided an access and evacuation apparatus for an offshore platform, in which the apparatus comprises an articulated arm for rotatably mounting on an offshore platform. The arm comprises an inner part which has first and second ends and an outer part also having first and second ends. The first end of the inner part is adapted for rotatably mounting on the platform and the second end of the inner part is rotatably connected to the first end of the outer part. The arm is selectively moveable between an upper position in which the second end of the outer part is adjacent the platform, and a lower position in which the second end of the outer part is below the surface of the water and remote from the platform. There is also provided a winch for controlling the arm and a cable operatively connecting the winch to the arm. A personnel craft and a support means for supporting the craft on the arm may also be provided.

In another aspect ofthe invention, the outer part is initially angled upwardly from the inner part.

In another aspect of the invention, the first end of the inner part of the arm is rotatably fixed to a the deck or a point adjacent the deck.

In another aspect of the invention, there is provided a restraining means attached to the platform and the second end of the inner part of the arm to limit rotation of the inner part to a pre-determined range of motion from a first position to a second position.

In another aspect of the invention, in lowering the arm, the angle between the inner part of the arm and the outer part of the arm is substantially fixed until the inner part has rotated through a predetermined range of motion.

In another aspect of the invention, the angle between the inner part ofthe arm and the outer part of the arm is chosen such that, when the inner part has rotated through a predetermined range of motion, the second end of the outer part has passed through a vertical line through the second end of the inner part.

In another aspect ofthe invention, the support means comprises a pick-up means on an outer part of the arm and a corresponding bracket means on the personnel craft.

In another aspect of the invention, the outer part is initially angled downwardly from the inner part.

BRIEF DESCRIPTION OF THE DRAWINGS

These and other advantages of the invention will become apparent upon reading the following detailed description and upon referring to the drawings in which.

Figure 1:
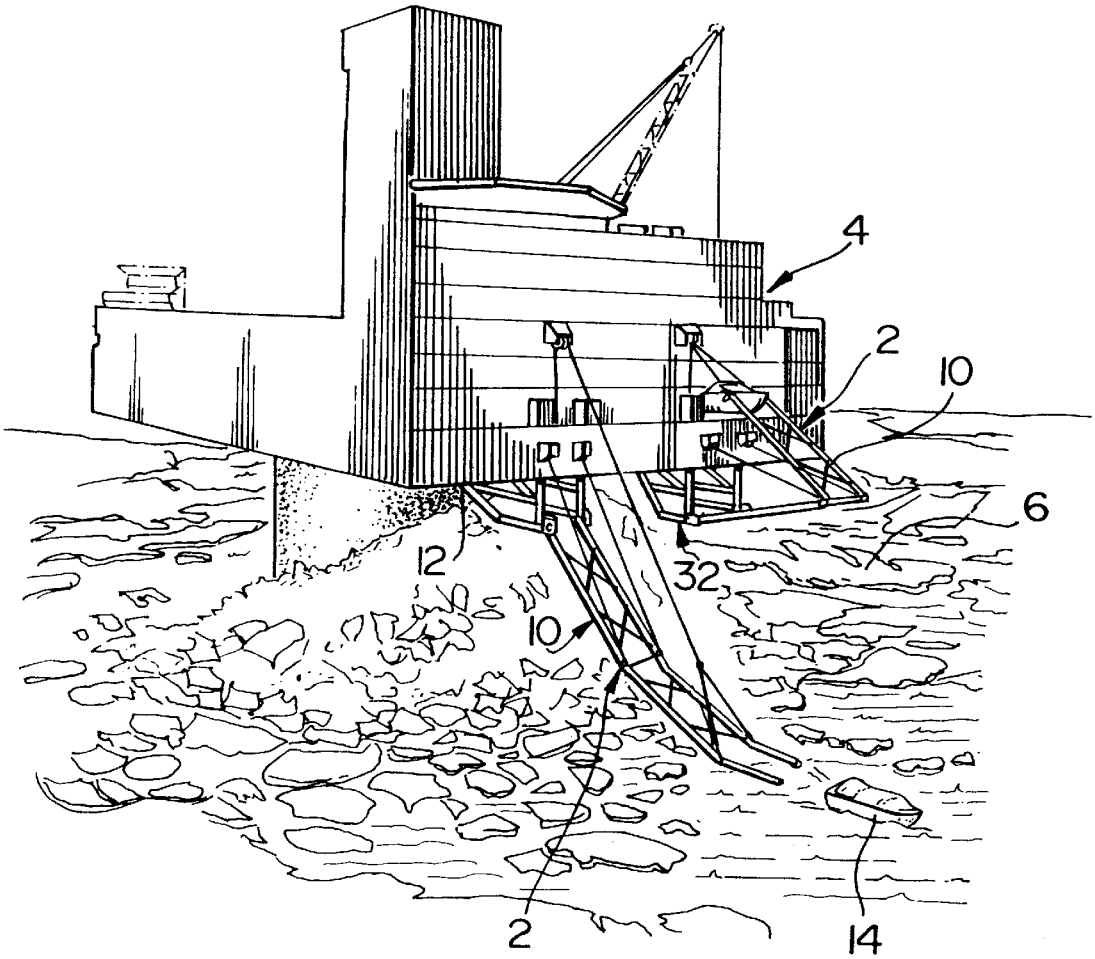
FIG. 1 is a perspective view of the access and evacuation apparatus of the present invention in place on an offshore work platform.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates an offshore platform 4 having two access and evacuation apparatus 2, shown to be located within a significant amount of ice rubble 6. The apparatus 2 comprises an articulated arm 10 rotatably mounted on the platform 4, for example on the underside 12 of the platform 4, as shown. A craft 14 used to transport personnel on and off the platform 4 and a winch 16 for controlling the arm 10 may also be provided.

Figure 2:
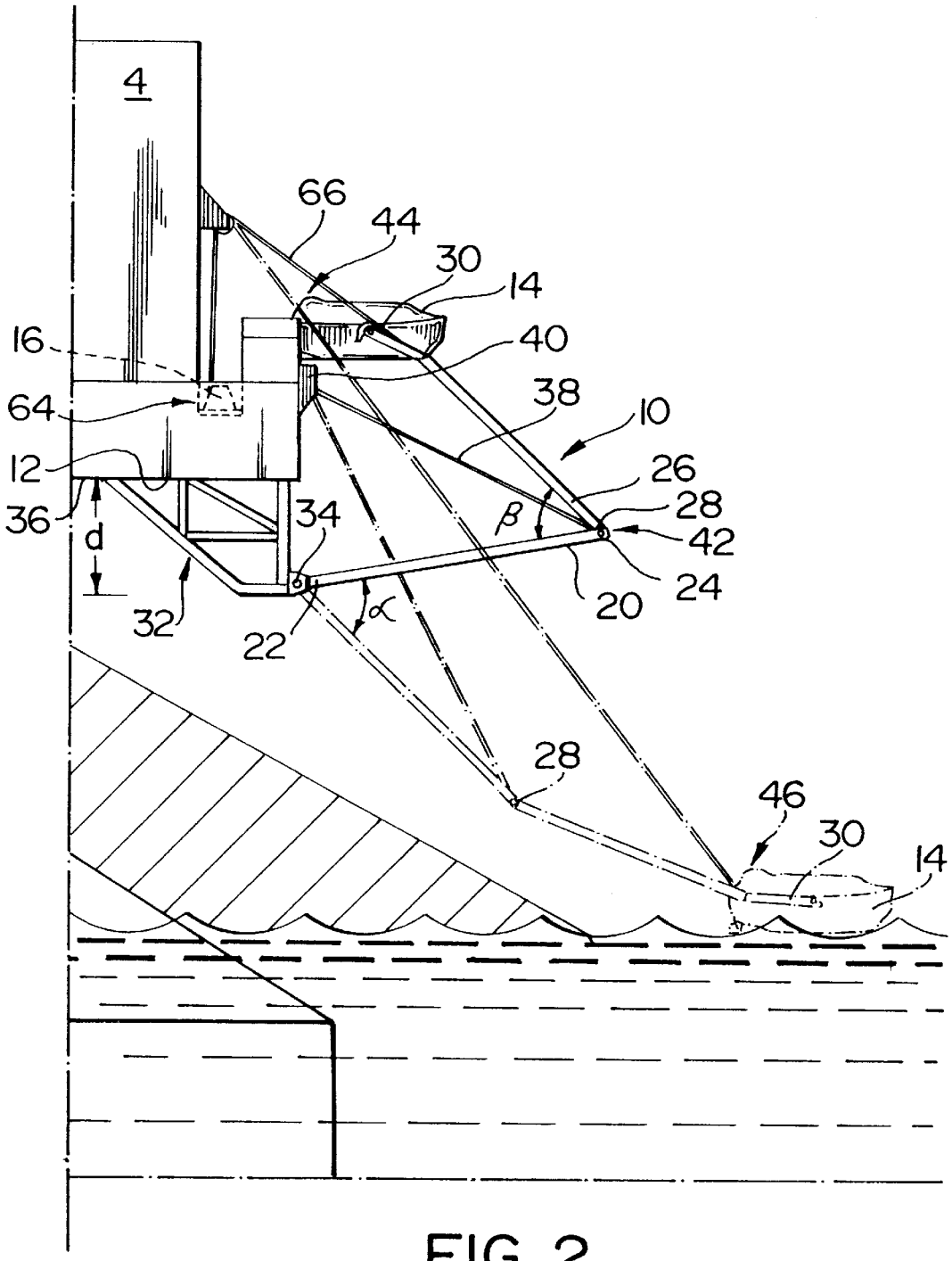
FIG. 2 is a side elevation view of the apparatus of the present invention.
Figure 3:
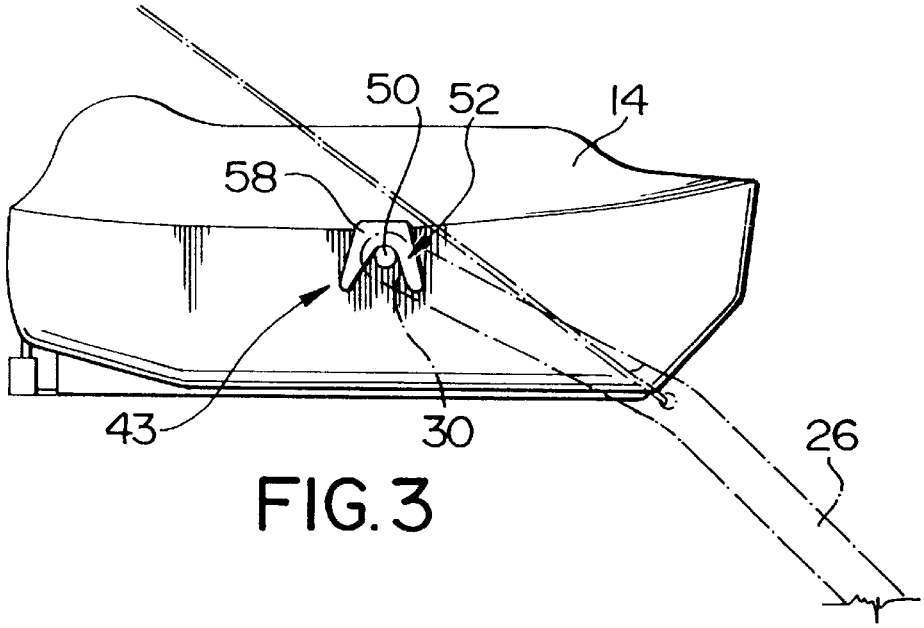
FIG. 3 is a partial side elevation view of the apparatus in accordance with an embodiment of the present invention.
Figure 4:
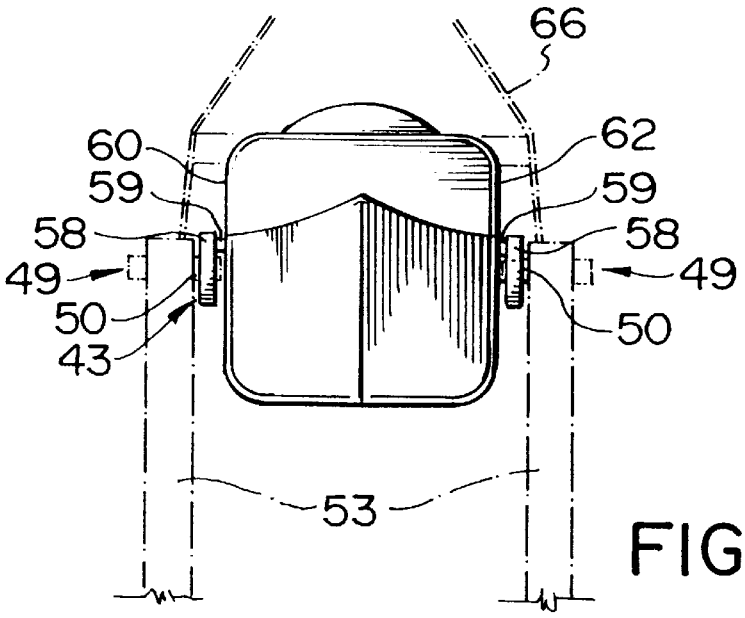
FIG. 4 is a partial front view of the apparatus in accordance with an embodiment of the present invention.
Figure 5:
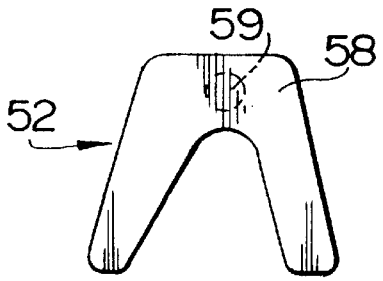
FIG. 5 is a front elevation view of the support means of the apparatus in accordance with an embodiment of the present invention.
Figure 6:
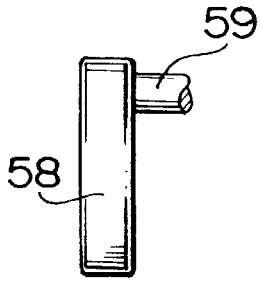
FIG. 6 is a side elevation view of the pick-up means of the apparatus in accordance with an embodiment of the present invention.

With reference to FIG. 2, the arm 10 comprises an inner part 20, which has a first end 22 and a second end 24, and an outer part 26, which has a first end 28 and a second end 30. The first end 22 is rotatably fixed to a framework 32(or the deck) in turn fixed to underside 12 of the platform 4. Inner part 20 may thus rotate about the pivot axis 34. The axis 34 is typically a distance d of about five (5) meters below the underside 12 of the platform 4. The amount of rotation of the inner part 20 of the arm 10 can be controlled by a restraining means, shown in the drawings as cable 38 typically attached to an outside face 40 of the platform 4 and to the second end 24 of inner part 20. A mechanical stop or braking mechanism may also be employed to limit the range of rotation of the inner part 20. The typical angle of rotation $\alpha$ of the inner part 20 will vary with the length of the inner part 20. For a length of approximately 15 meters, the angle of rotation a is preferably in the range of 30 to 40°.

The inner part 20 and outer part 26 of the arm 10 are pinned together at 42 so that the outer part 26 may rotate relative to the inner part 20. Again, the relative angle $\beta$ between the outer 26 and inner 20 parts will vary with the respective lengths of the parts. As well, the distance d below the platform 4 at which the first end 22 of the inner part 20 is fixed to the structure 12 will affect the angle $\beta$. For a distance d of 5 meters, and parts 20 and 26 of equal length of approximately 15 meters, angle $\beta$ will preferably be initially approximately 45 degrees.

The arm 10 is preferably constructed such that both parts 20 and 26 comprise spaced parallel members suitably braced. In any event, the second end 30 of outer part 26 comprises a pair of members 53 between which the craft 14 may be supported.

With reference to FIGS. 3–6 a novel carrying arrangement 43 for supporting the craft 14 on the arm 10 and deploying the craft 14 in the water, has also been developed to account for the rotation of the arm 10 and particularly the outer part 26. It is of course very important to maintain the trim of the craft 14 as level as possible while moving between an upper position 44 in which the second end 30 of the outer part 26 is adjacent the platform 4 and a lower position 46 in which the second end 30 is at or below the surface of the water and remote from the platform 4.

The novel arrangement consists of a pick-up means 49 mounted on members 53 at the second end 30 of outer part 26 and support or bracket means 52 mounted to the craft 14 for mating with the pick-up means 49. The pick-up means 49 comprises a spaced pair of coaxial pins 50 extending inwardly between members 53.

The support means 52 preferably comprises a pair of brackets 58, one mounted on a respective support 59 to each side 60 and 62 of the craft 14 and having an internal radius r to receive the cylindrical members 50 so that the craft 14 and the brackets 58 are free to rotate about members 50.

In use, the winch 16 will be placed on the platform 4 in an area 64 protected from extreme wind chill factors and ice accretion. The craft 14 may be stored close to the platform 4 with the arm in the upper position 44 so that personnel may be quickly evacuated from the platform 4 in the case of fire or other emergency. The movement of the arm 10 is controlled by the winch 16 and the cable 66 operatively connecting the winch 16 to the outer part 26 of the arm 110, adjacent to the members 53, to pay out at a controlled rate.

During deployment of the arm 10, as shown in the series of drawings in FIGS. 7*a* to 7*d*, the inner part 20 will begin to rotate about the pivot point 34 through the maximum pre-determined range of motion, and the outer part 26 is required to rotate with it. That is, the angle β is mechanically fixed as the minimum angle between parts 20 and 26 during this first phase of a launch. Once the inner part 20 has rotated its full amount, its rotational movement is stopped by the cable 38. The angle β between the inner part 20 and the outer part 26 is chosen such that when the rotation of the inner part 20 has stopped, the second end 30 of the outer part 26 has passed through a vertical line through the second end 24 of the inner part. In common parlance, the center of gravity of the craft 14 will have passed "top dead centre".

Figure 7A:
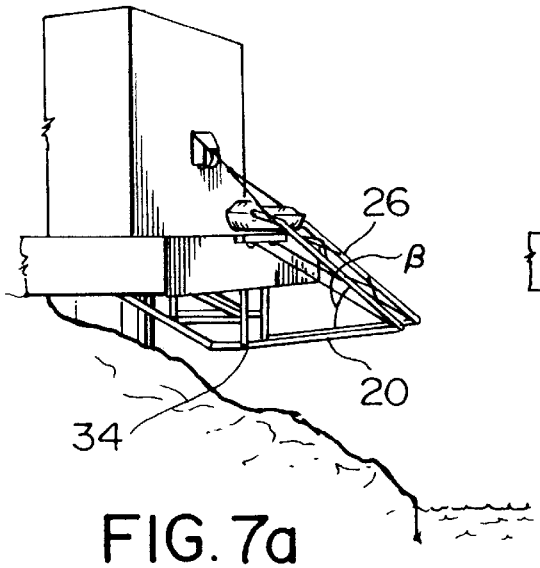
FIGS. 7*a* to 7*d* are perspective views ofthe apparatus of the present invention shown in varying stages of deployment.
Figure 7B:
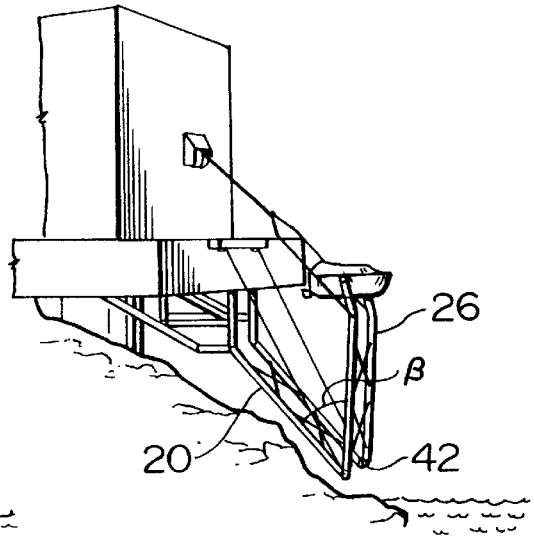
Figure 7C:
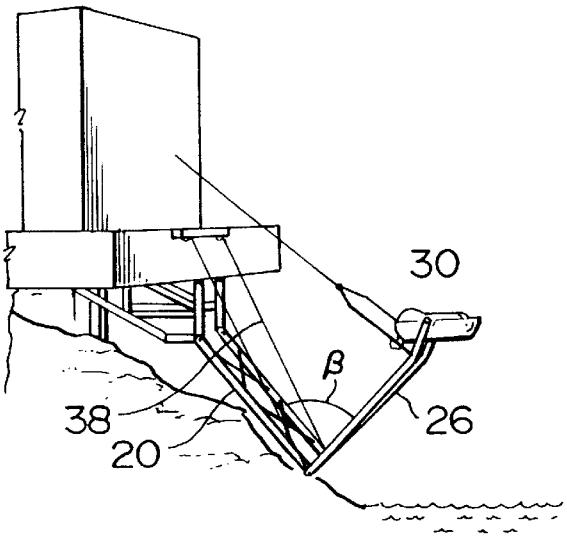
Figure 7D:
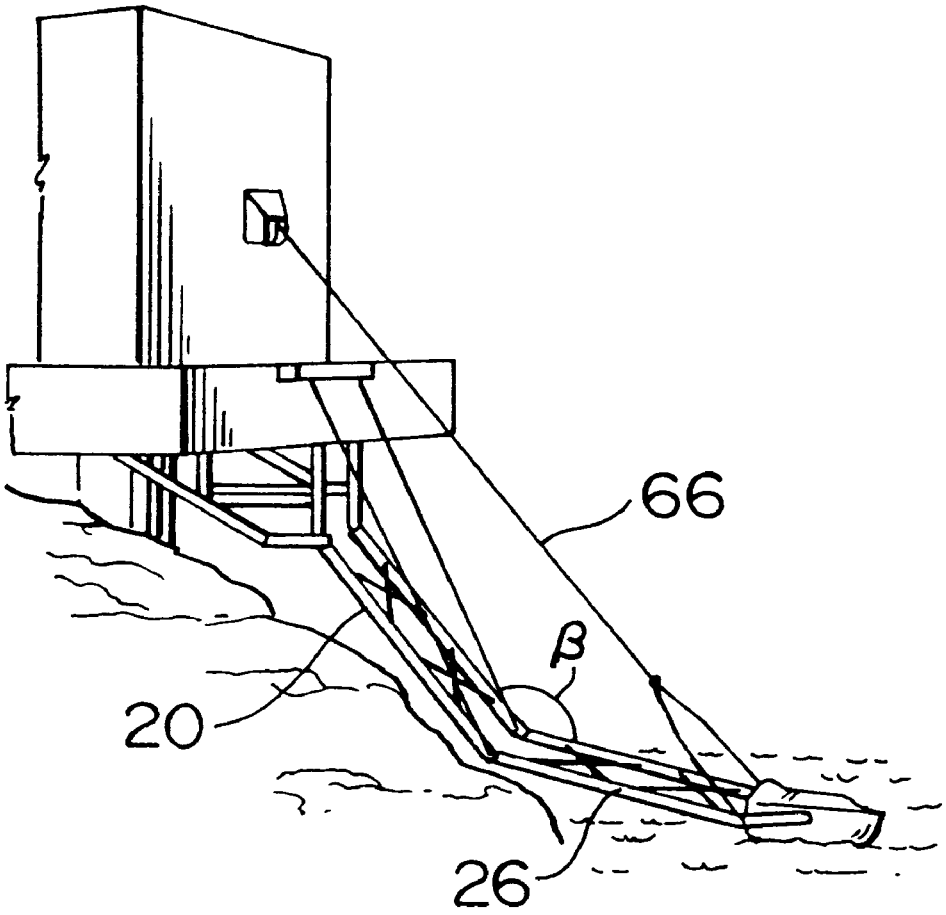

The outer part 26 then rotates about the pivot connection 42 from the intermediate position shown until the craft 14 reaches the water as shown in FIG. 7*d*. When the craft 14 reaches the water, further rotation of the part 20 allows the craft 14 to float off of the pins 50 and move away from the arm 10. The outer part 26 continues to rotate through to the lower position 46 below the surface of the water remote from the platform 4 and away from the craft 14 to prevent further interaction with the craft 14.

In all, the outer part 26 will typically preferably rotate through an angle of up to about 200° relative to the inner part 20, although other angles of rotation will be acceptable.

The invention also contemplates use in partial or complete ice conditions. In that situation outer part 26 may not be able to rotate below water level and away from the craft 14. Nonetheless, there will be sufficient rotation to release the craft 14 even if the craft 14 is on top of the ice.

The speed at which the craft 14 is lowered may/can vary for different environmental conditions into which the craft 14 is being deployed. In severe sea conditions the winch 16 can control the speed of the craft 14 to be at a vertical velocity of approximately 2.5 meters per second. When extreme ice cover is present, the winch 16 is designed to allow deployment at a rapid rate during the first segment of the launch, but to automatically reduce the vertical velocity during the second, final, segment. This places the craft 14 gently on the ice without causing structural damage to the craft 14 itself, or injury to the personnel being transported within the craft 14.

Two general embodiments are specifically contemplated in the design of the apparatus 2. In the first, the inner part 20 would take about 15 seconds to rotate from the upper position 44 to the intermediate position shown in FIG. 7b. The rotation of the outer part 26 would automatically speed up increasing the vertical velocity ofthe craft 14 to approximately 2.5 meters per second. Total launch time, from the upper position 44 to the lower position 46 would be preferably about 35 seconds.

The second embodiment is contemplated for launch onto an ice field with up to complete ice cover. The inner part 20 would rotate at the same speed as the first embodiment. However, the winch 16 would then slow the pay-out rate of the cable 64, thus slowing the rotation of the outer part 26 and hence the vertical velocity ofthe craft 14. The total deployment time will be preferably about 1.25 minutes.

In either embodiment, the craft 14 will be deployed and the arm 10 will continue to rotate into the water sufficiently to release craft 14.

Figure 8A:
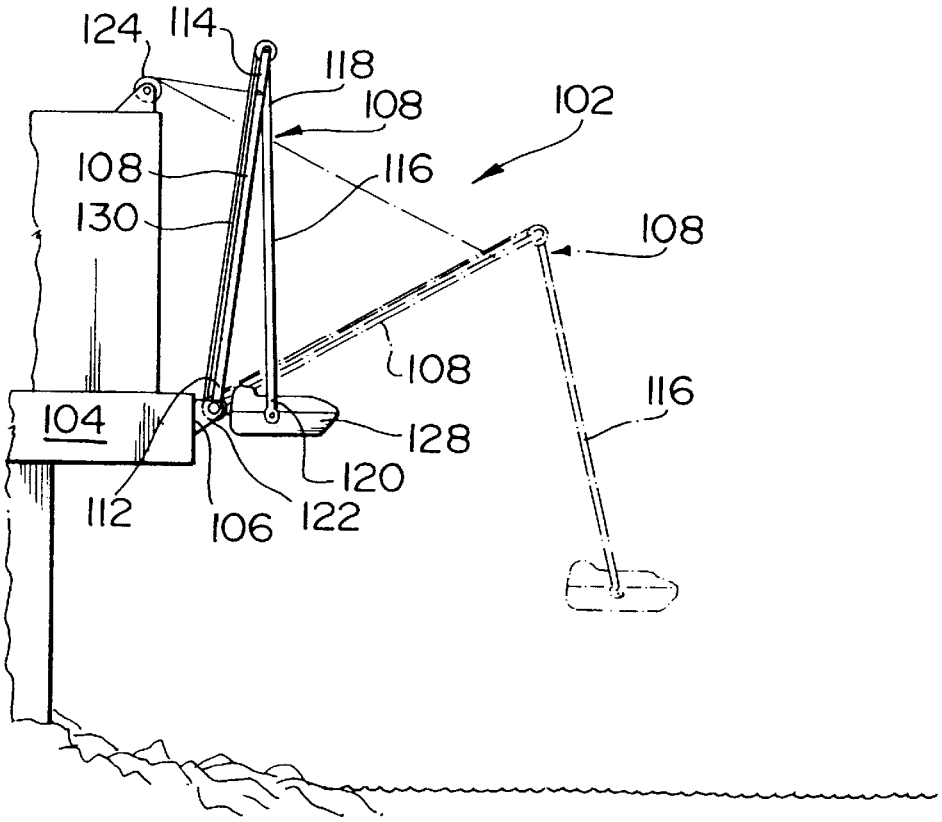
FIGS. 8*a* and 8*b* are side views of an alternate embodiment of the access and evacuation apparatus of the present invention.
Figure 8B:
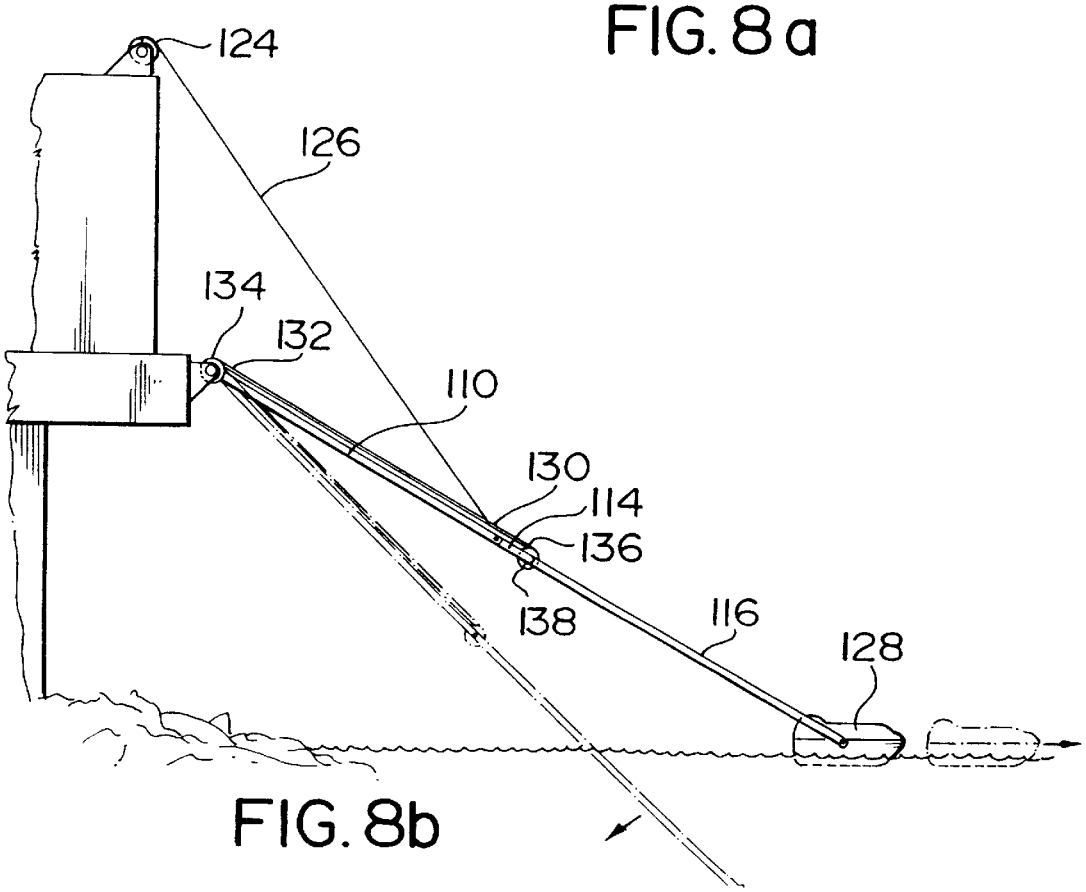

In an alternate embodiment of the present invention as illustrated in FIGS. 8*a* and 8*b*, the apparatus 102 is pinned to the platform 104 in a manner such that it is free to rotate about the pivot axis 106. The apparatus 102 comprises an arm 108 having an inner part 110 which has a first end 112 and a second end 114, and an outer part 116 which has a first end 118 and a second end 120. The second end 114 of the inner part 110 is rotationally connected to the first end 118 of the outer part 116. There is also provided a winch 124 on the platform 104 with a winch cable 126 attached to the inner part 110 at a point below the second end 114. The inner part 110 is held in place prior to operation by a brake on the winch 124. Releasably held at second end 120 there is shown a craft 128 used to transport personnel on and off the platform 104.

A mechanical connection is provided between inner part 110 and outer part 116 to increase angle γ between the two parts responsive to the lowering of inner part 110 by cable 126.

In one preferred mode for effecting this mechanical connection, a cable 130, or series of cables, are positioned parallel to the inner part 110, as shown. At one end 132 thereof, the cable 130 is wrapped around a first drum 134, the drum 134 being fixed at the first end 112 to the deck, preferably in a clockwise direction. The other end 136 of the cable 130 is wrapped around a second drum 138 fixed to the first end 118 of the outer part 116 by a weld or the like. The second drum 138 is thus not free to independently rotate about its axis. Rather, when the second drum 138 rotates to take up or release the cable 130, the outer part 116 rotates with it.

In operation, the winch brake 124 is released such that the apparatus 102 is free to move. The winch wire 126 pays out as gravity forces the arm 108, with the craft 128 attached, downwardly. As the inner part 110 rotates, the cable 13O is taken up around the first drum 134 The resulting tension in the cable 130 pulls against the second drum 138 causing it to rotate in a counterclockwise direction. That counterclockwise rotation is translated to outer part 116 (as described above) as a downward tension in order to pivot outer part 116 upwardly and outwardly against the gravitational pull acting on the arm 108 relative to the rotation of the inner part 110 (as shown in phantom in FIG. 8*a*). Thus, as shown in FIG. 8*b*, the craft 128 may be placed in the water or on the ice remote from the platform 104 in a manner similar to the first embodiment described herein, at which point the arm 108 continues to rotate into the water (as shown in phantom in FIG. 8*b*).

Thus, it is apparent that there has been provided in accordance with the invention an access and evacuation apparatus for an offshore platform that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An access and evacuation apparatus for an offshore platform, said apparatus comprising:

an articulated arm for rotatably mounting on an offshore platform, said arm comprising an inner part having a first end for rotatably mounting on said platform and a second end, and an outer part having first and second ends, wherein said second end of said inner part is directly rotatably connected to said first end of said outer part, and wherein said arm is selectively moveable between an upper position in which said second end of said outer part is adjacent said platform, and a lower position in which said first end of said outer part remains directly rotatable connected to said second end of said inner part and said second end of said outer part is remote from and at a level below said second end of said first part and is at or below the surface of the water or ice and remote from said platform;

a winch for mounting on said platform; and a cable for operatively connecting said winch to said arm.

2. The apparatus of claim 1 wherein said outer part is initially angled upwardly from said inner part.

3. The apparatus of claim 2 further comprising restraining means attached between said platform and said second end of said inner part to limit rotation of said inner part to a predetermined maximum range of motion from a first position to a second position relative to said platform.

4. The apparatus of claim 3 wherein said restraining means comprises a cable fixed to said platform and to said second end of said inner part.

5. The apparatus of claim 3 wherein the angle defined between said inner part and said outer part is chosen such that, when said inner part has rotated through said maximum range of motion, said second end of said outer part is past a vertical line through said second end of said inner part.

6. The apparatus of claim 2 wherein, in lowering said arm, the angle defined between said inner part and said outer part is substantially fixed until said inner part has rotated through a predetermined range of motion.

7. The apparatus of claim 6 wherein said angle between said inner part and said outer part is chosen such that, when said inner part has rotated through said predetermined range of motion, said second end of said outer part is past a vertical line through the second end of said inner part.

8. The apparatus of claim 2 further comprising a support means for supporting a personnel craft on said arm.

9. The apparatus of claim 8 wherein said support means comprises a pick-up means on said second end of said outer part and a bracket means on said craft for mating with said pick-up means.

10. The apparatus of claim 9 wherein said pick-up means comprises a spaced parallel pair of members at least at said second end of said outer part and a pair of cylindrical members extending transversely inwardly, one from each of said parallel members.

11. The apparatus of claim 9 wherein said bracket means comprises a pair of brackets, one mounted on each side of said craft, said brackets having an internal radius to receive said pick-up means.

12. The apparatus of 9 claim wherein said brackets are in a downwardly opening configuration throughout the movement of said arm.

13. The apparatus of claim 1 wherein said outer part is initially angled downwardly from said inner part.

14. The apparatus of claim 13 further comprising at least one cable secured between a point adjacent said first end of said inner part and said first end of said outer part.

15. The apparatus of claim 14 further comprising a first drum fixed to said platform and a second drum fixed to said first end of said outer part, said cable secured between said first drum and said second drum, such that as said inner part rotates downwardly, said cable is taken up on said first drum in a clockwise direction thereby creating a counterclockwise tension on said second drum and said outer part urging said outer part to rotate upwardly and outwardly.

16. An access and evacuation apparatus for an offshore platform, said apparatus comprising:

an articulated arm for rotatably mounting on an offshore platform, said arm comprising an inner part having a first end for rotatably mounting on said platform and a second end, wherein said first end of said inner part is rotatably fixed to a bottom part of said platform, and an outer part having first and second ends, wherein said second end of said inner part is rotatably connected to said first end of said outer part, and wherein said arm is selectively moveable between an upper position in which said second end of said outer part is adjacent said platform, and a lower position in which said second end of said outer part is at or below the surface of the water or ice and remote from said platform;

a restraining means attached between said platform and said second end of said inner part to limit rotation of said inner part to a pre-determined maximum range of motion from a first position to a second position;

a winch for mounting on said platform;

a cable for operatively connecting said winch to said arm;

a personnel craft; and a support means for supporting said craft on said arm, wherein said support means comprises a pick-up means on said second end of said outer part, said pick-up means comprising a pair of cylindrical members extending transversely inwardly from a pair of spaced parallel members at least at said second end, and a bracket means for mating with said pick-up means, said bracket means comprising a pair of brackets, one mounted on each side of said craft, said bracket having an internal radius to receive said pick-up means, wherein in lowering said arm, the angle between said inner part and said outer part is substantially fixed until said inner part has rotated through a predetermined range of motion and the angle between said inner part and said outer part is chosen such that, when said inner part has rotated through said predetermined range of motion, said second end of said outer part is past a vertical plane through the second end of said inner part normal to the axis of rotation of said arm.

17. An access and evacuation apparatus for an offshore platform, said apparatus comprising:

an articulated arm for rotatably mounting on an offshore platform, said arm comprising an inner part having a first end for rotatably mounting on said platform and a second end, and an outer part having first and second ends, wherein said second end of said inner part is rotatably connected to said first end of said outer part, and wherein said arm is selectively moveable between an upper position in which said outer part is angled upwardly from said inner part and said second end of said outer part is adjacent said platform, and a lower position in which said second end of said outer part is at or below the surface of the water or ice and remote from said platform; and wherein, in lowering said arm, the angle defined between said inner part and said outer part is substantially fixed until said inner part has rotated through a predetermined range of motion;

a winch for mounting on said platform; and a cable for operatively connecting said winch to said arm.

18. The apparatus of claim 17 wherein said angle between said inner part and said outer part is chosen such that, when said inner part has rotated through said predetermined range of motion, said second end of said outer part is past a vertical line through the second end of said inner part.

19. An access and evacuation apparatus for an offshore platform, said apparatus comprising:

an articulated arm for rotatably mounting on an offshore platform, said arm comprising an inner part having a first end for rotatably mounting on said platform and a second end, and an outer part having first and second ends, wherein said second end of said inner part is rotatably connected to said first end of said outer part, and wherein said arm is selectively moveable between an upper position in which said outer part is angled upwardly from said inner part and said second end of said outer part is adjacent said platform, and a lower position in which said second end of said outer part is at or below the surface of the water or ice and remote from said platform;

restraining means attached between said platform and said second end of said inner part to limit rotation of said inner part to a predetermined maximum range of motion from a first position to a second position relative to said platform; and wherein the angle defined between said inner part and said outer part is chosen such that, when said inner part has rotated through said maximum range of motion, said second end of said outer part is past a vertical line through said second end of said inner part;

a winch for mounting on said platform; and a cable for operatively connecting said winch to said arm.

20. An access and evacuation apparatus for an offshore platform, said apparatus comprising:

an articulated arm for rotatably mounting on an offshore platform, said arm comprising an inner part having a first end for rotatably mounting on said platform and a second end, and an outer part having first and second ends, wherein said second end of said inner part is rotatably connected to said first end of said outer part, and wherein said arm is selectively moveable between an upper position in which said outer part is angled upwardly from said inner part and said second end of said outer part is adjacent said platform, and a lower position in which said second end of said outer part is at or below the surface of the water or ice and remote from said platform;

a winch for mounting on said platform;

a cable for operatively connecting said winch to said arm; and support means for supporting a personnel craft on said arm, said support means comprising a pick-up means on said second end of said outer part and a bracket means on said craft for mating with said pick-up means.

21. The apparatus of claim 20 wherein said pick-up means comprises a spaced parallel pair of members at least at said second end of said outer part and a pair of cylindrical members extending transversely inwardly, one from each of said parallel members.

22. The apparatus of claim 20 wherein said bracket means comprises a pair of brackets, one mounted on each side of said craft, said brackets having an internal radius to receive said pick-up means.

23. The apparatus of claim 20 wherein said brackets are in a downwardly opening configuration throughout the movement of said arm.

24. An access and evacuation apparatus for an offshore platform, said apparatus comprising:

an articulated arm for rotatably mounting on an offshore platform, said arm comprising an inner part having a first end for rotatably mounting on said platform and a second end, and an outer part having first and second ends, wherein said second end of said inner part is rotatably connected to said first end of said outer part, and wherein said arm is selectively moveable between an upper position in which said outer part is angled downwardly from said inner part and said second end of said outer part is adjacent said platform, and a lower position in which said second end of said outer part is at or below the surface of the water or ice and remote from said platform;

at least one cable secured between a point adjacent said first end of said inner part and said first end of said outer part;

a winch for mounting on said platform; and a cable for operatively connecting said winch to said arm.

25. The apparatus of claim 24 further comprising a first drum fixed to said platform and a second drum fixed to said first end of said outer part, said at least one cable secured between said first drum and said second drum, such that as said inner part rotates downwardly, said cable is taken up on said first drum in a clockwise direction thereby creating a counterclockwise tension on said second drum and said outer part urging said outer part to rotate upwardly and outwardly.

* * * * *

UNITED STATES PATENT AND TRADEMARK OFFICE

CERTIFICATE OF CORRECTION

PATENT NO.: 6,138,605
DATED : October 31, 2000
INVENTOR: Daniel P. O'Brien

It is certified that error appears in the above-identified patent and that said Letters Patent is hereby corrected as shown below:

Claim 1, line 7, of column 7

"rotatable" should be - - rotatably - -

Signed and Sealed this

First Day of May, 2001

*Attest:*

Nicholas P. Godici

NICHOLAS P. GODICI

*Attesting Officer*

*Acting Director of the United States Patent and Trademark Office*